United States Patent [19]

Petersson et al.

[11] 4,244,733

[45] Jan. 13, 1981

[54] METHOD OF PRODUCING BLISTER COPPER FROM COPPER RAW MATERIAL CONTAINING ANTIMONY

[75] Inventors: Stig A. Petersson, Skelleftehamn; Bengt S. Eriksson, Skelleftea; Arne C. Fridfeldt, Skelleftehamn, all of Sweden

[73] Assignee: Boliden Aktiebolag, Stockholm, Sweden

[21] Appl. No.: 47,712

[22] PCT Filed: Apr. 12, 1979

[86] PCT No.: PCT/SE78/00030

§ 371 Date: Apr. 19, 1979

§ 102(e) Date: Apr. 12, 1979

[87] PCT Pub. No.: WO79/00104

PCT Pub. Date: Mar. 8, 1979

[30] Foreign Application Priority Data

Aug. 19, 1977 [SE] Sweden ..... 7709355

[51] Int. Cl.[3] ..... C22B 15/00

[52] U.S. Cl. ..... 75/72; 75/74; 75/75

[58] Field of Search ..... 75/72, 74, 75,

[56] References Cited

U.S. PATENT DOCUMENTS

| | | | |
|---|---|---|---|
| 3,069,254 | 12/1962 | Queneau et al. | 75/82 |
| 3,432,289 | 3/1969 | Spitz et al. | 75/73 |
| 3,516,818 | 6/1970 | O'Neill et al. | 75/82 X |
| 3,615,361 | 10/1971 | Queneau et al. | 75/73 |
| 3,615,362 | 10/1971 | Warner et al. | 75/75 |
| 3,884,680 | 5/1975 | Bie | 75/72 |

FOREIGN PATENT DOCUMENTS

| | | | |
|---|---|---|---|
| 260671 | 1/1970 | U.S.S.R. | 75/74 |

*Primary Examiner*—F. C. Edmundson

*Attorney, Agent, or Firm*—Stevens, Davis, Miller & Mosher

[57] ABSTRACT

A method of producing blister copper from raw material containing antimony. The invention is characterized in that a slag is separated from copper matte formed by smelting the raw material. Thereafter the matte is brought into contact, under violent agitation preferably in a rotary converter of the Kaldo type, with a substantially inert gas in a quantity sufficient to reduce by volatilization the antimony content of the copper matte and, possibly, also the content of other impurities such as bismuth, arsenic and zinc to a level acceptable when performing the subsequent converting process, so as to obtain the desired blister copper product, preferably a maximum content of antimony, 0.04 percent by weight and of bismuth 0.03 percent by weight. The rotary converter is suitably operated with a rotation corresponding to a peripheral speed of approximately 0.5–7 m/s, preferably 2–5 m/s.

16 Claims, No Drawings

METHOD OF PRODUCING BLISTER COPPER FROM COPPER RAW MATERIAL CONTAINING ANTIMONY

The present invention relates to a method of producing blister copper from copper raw material containing antimony, said method comprising smelting the copper raw material to form a copper matte and a slag, and converting the copper matte to blister copper.

Blister copper is normally produced from a sulphidic copper material, which most often contains iron. In the majority of methods applied, the material is first partially roasted and the roasted products then smelted to form a copper matte. The matte smelt is then converted to blister copper by injecting therein to an oxygen-containing gas, which is normally air, whilst at the same time slagging iron oxides by adding silica, such as sand. In the partial-roasting step, in which the sulphidic copper material is heated by oxidation of the sulphur therein whilst supplying oxygen, the sulphur content in the roasted product is adjusted in a manner such that the amount of sulphur present is sufficient to form a copper matte having the desired copper content in respect of the subsequent smelting process. A copper matte produced in this way normally contains 30–40% copper and 22–26% sulphur. The chemical composition of the matte in question will naturally vary with the composition of the raw material used and with the extent to which it is roasted. The given values, however, are representative of a copper matte produced from the most common of copper raw materials.

When smelting the roasted products there is formed, in addition to a copper matte, an iron-containing slag which is given a suitable composition by adding sand ($SiO_2$) thereto and, in certain cases, minor quantities of limestone thereby to impart a low viscosity to the slag. The slag, which normally contains approximately 0.4–0.8% copper, is tapped-off and dumped, i.e. deposited in some suitable location. Sometimes the slag will also contain significant quantities of zinc and other valuable metals, which, if desired, can be recovered in slag-fuming processes.

The copper matte will often contain impurities which are difficult to remove when applying conventional conversion processes in PS-converters and which are undesirable inclusions in blister copper.

Among those impurities most difficult to remove are antimony, arsenic, bismuth and tin, and hence such impurities can only be present in limited quantities in a copper matte processed in accordance with conventional methods. Known pyrometallurgical processes for eliminating these impurities from the final blister copper are either not effective enough or too expensive.

For the purpose of eliminating such impurities from a copper-nickel sulphide bath in top blown rotary converters, e.g. of the Kaldo type, it is proposed in Swedish Published specification 355 603 (INCO) that the sulphide bath is surface blown with a neutral or slightly oxidizing atmosphere over the bath, thereby to partially volatilize the impurities contained therein. Temperatures of 1300°–1500° C. are proposed, as is also the presence of an atmosphere which is substantially neutral with respect to copper sulphide; also proposed is the vacuum treatment of the blister copper, thereby to promote the elimination of the aforementioned impurities. Further, it is stated that any iron present in the sulphide bath shall be oxidized prior to volatilizing the impurities. Of the aforementioned impurities, however, it is stated that antimony is particularly difficult to eliminate by vaporization from the sulphide phase or by subsequent oxidation and volatilization from the metal phase. Consequently it is proposed that antimony is eliminated from the process by transferring the antimony to a metal phase which is formed by oxidizing a minor part of the copper-nickel-sulphide smelt, and then is said metal phase containing the antimony impurities removed from the furnace and treated separately. This process is repeated until the antimony content of the remaining copper sulphide smelt reaches an acceptable level.

The procedural steps of the INCO method are best understood from the examples recited in the aforementioned Swedish specification, in which it is stated, for example, that the copper matte is first surface blown with oxygen from 0.5 hr to 1 hr, whereafter the partially oxidized matte thus obtained is blown with nitrogen for two hours and then again with oxygen for 1 hour, to obtain thereby a metal phase, and thereafter for a little more than one hour to form a new metal phase. The metal phases, which have high contents of antimony and also of valuable metals, are removed from the furnace for separate treatment. This method is thus very complicated and expensive, since separate treatment of certain products is required. Furthermore, it is completely unsatisfactory with respect to the treatment of a copper matte having a high antimony content, since large quantities of metal phase must be separated in order to recover the antimony.

A method of eliminating antimony in the pyrometallurgical treatment of copper smelt material having more than 0.1% antimony is proposed in SE Patent No. 7603237-4. In this method, material containing antimony is smelted in an inclined rotary converter together with iron-containing slag, in quantities such that the total iron content reaches at least 44 times the amount of antimony present, a certain amount of the antimony passing through the slag phase, whereafter the matte smelt thus formed is converted to white metal by blowing oxygen gas thereinto, with a reduced antimony content. It will be perceived that use of this method in practice is limited to the treatment of material having a relatively low antimony content and a relatively high iron content. The method also causes an unnecessary ballast in the furnace, in the form of added slag. In the aforementioned Swedish Patent to which reference is made here, mention is also made of other, previously proposed methods for the elimination of antimony, all of which, however, are restricted to small antimony contents in the starting material.

Many available copper raw materials have a relatively high content of antimony, which is thus difficult to remove to the necessary extent when using the conventional methods of smelting and converting copper raw material. In the electrolytic refining of copper, which is the final refining stage most applied today in the production of refined copper for electrical purposes, so-called electrolysis copper, the amount of antimony in the starting material, the so-called anode copper, may not exceed 400 g/t if a disturbance-free electrolysis is to be carried out. In order to maintain the antimony content at this level, it has been found that the amount of antimony in a matte containing 40% copper must not exceed 0.15%, when the matte is converted in a conventional PS-converter. When the copper content is as high as 45%, the amount of antimony present may not exceed 0.13%. This means that with conventional copper processes, the antimony content of the starting material may not generally exceed 0.1%–0.3%, depending upon the copper content of the matte. It is doubtful whether material having more than 0.2% Sb can be treated by conventional processes with satisfactory economy and results. When blowing such matte in a conventional converter, the antimony content falls to approximately 0.08% in the copper sulphide smelt formed (the white metal). At this impurity level, the antimony content in the blister copper or anode copper produced subsequent to the converting process will be less than 400 g/t (0.04%) which is thus acceptable for the electrolysis process.

As previously mentioned, a plurality of pyrometallurgical methods for eliminating antimony from copper matte, white metal and/or blister copper have been tried. The efficiency of these methods is too low, or the methods are also economically unrealistic, and hitherto no technically and economically acceptable process for reducing the antimony content of blister copper to a level beneath 0.04% has been proposed.

A normal method of reducing the antimony content of blister copper is to treat the blister copper with soda, subsequent to the converting process, there being formed by the soda a slag which is able to take up minor quantities of antimony. The so-called soda refining process is normally only applied in cases of necessity, when an excessive quantity of antimony has been charged to the process. The costs for the chemicals become high, and the soda also causes significant wear of the bricks in the converter and an increase in the quantity of return copper accompanying the slag formed.

In order to ensure a low antimony limit, it is therefore often necessary to mix with the antimony-containing copper raw-material, a substantially antimony-free copper smelt material, which requires a rigorous sampling and controlling of the ingoing smelt material and which limits the freedom of selection of raw material. As a result hereof large quantities of antimony-rich copper smelt material are circulating on the market having a greatly reduced demand.

Among those other impurities which, similar to antimony, create problems as a result of the difficulty encountered in separating them sufficiently from the copper during the smelting and converting processes can be mentioned bismuth, arsenic and zinc.

The present invention proposes a method in which the aforementioned disadvantages and limitations encountered when producing blister copper from antimony-containing copper smelt material are substantially eliminated in a surprisingly simple manner, at the same time as significant separation of other difficultly separatable impurities can be achieved. The invention is characterized in that the slag is separated from the copper matte, whereupon the copper matte prior to being converted to blister copper, is brought into contact, under violent agitation, with a substantially inert gas in a quantity sufficient to reduce by volatilization the antimony content of the copper matte and, possibly also the content of other impurities such as bismuth, arsenic and zinc to a level acceptable when performing the subsequent converting process to obtain the desired blister copper product.

The method can be carried out in furnaces in which the agitation of the blister copper is effected mechanically, pneumatically or electromagnetically, although it can be applied to particular advantage when said agitation is effected by rolling the copper matte in a rotary converter of the Kaldo type, this type of furnace having been discussed in detail above. Rolling of the copper matte is suitably effected with a furnace rotation corresponding to a peripheral speed at the cylindrical inner wall of the furnace of approximately 0.5–7 m/s, preferably 2–5 m/s. At such a peripheral speed, the furnace rotates at a speed of 10–60 r.p.m., depending upon the diameter of the furnace. A large furnace having a diameter of approximately five meters will reach a suitable peripheral speed at a furnace rotation of only 10 r.p.m., while furnaces having a diameter smaller than one meter should be rotated at a speed greater than 40 r.p.m., in order to achieve the intended agitation and contact between gas phase and smelt. The substantially inert gas may, to advantage, comprise a combustion product of oil and oxygen or oxygen-enriched air. Suitably there is used an oxygen-oil-burner which can be readily regulated and rapidly set to a suitable degree of combustion.

The time period over which the aforementioned rolling treatment is carried out vary naturally with the amounts of the impurities to be volatilized present in the smelt, although other reasons may influence the length of time over which rolling is carried out. The possibilities of further reducing the contents of impurities during subsequent process steps depends upon the choice of the method by which the matte is converted to blister copper. Thus, the chance of eliminating such impurities is slightly better when converting the matte in a Kaldo converter than when converting said matte in a PS-converter, as indicated above. Economic considerations can also influence the extent to which the impurities are eliminated in the rolling stage; for example whether a further refining stage, such as the aforementioned soda-refining of the blister copper, shall be undertaken or not. It is preferred, however, to continue the rolling treatment for a length of time such that a maximum content of approximately 0.04% antimony and approximately 0.03% bismuth is ensured in the final blister copper. It will be understood that the temperature during the rolling treatment process shall be sufficiently high to volatilize the impurities present, although as a result of the favourable conditions created with said strong agitation, the temperature can be limited in comparison with methods known hitherto, and it is thus preferred that during the rolling treatment process the temperatures are maintained within a range of approximately 1250°–1350° C. Neither is the copper content of the matte particularly critical, and copper contents of up to approximately 80% can thus be tolerated, although as opposed to hitherto known eliminating methods, in which matte containing more than 60% copper cannot successfully be treated, antimony can be effectively eliminated right down to a copper content of approximately 25%. It is preferred, however, that the copper content of the matte undergoing the rolling treatment process is approximately 25–60%. It is particularly preferred that said copper content is approximately 30–40%. In certain instances it can be an advantage, in conjunction with the rolling treatment process, to add to the copper matte a slag former, such as sand. The method according to the invention can be used to advantage to produce from silver-containing copper raw material having a very high antimony content a blister copper having a high silver content and low antimony content. The silver content of the blister copper can then be separated therefrom and recovered by special pyrometallurgical or hydrometallurgical processes. For the purpose of optimizing volatilization and of reducing the time required heretofore and to reduce the fuel consumption, the volatilization of antimony is preferably carried out without substantial oxidation of the matte. If a slag phase is formed, or is present, the requisite rolling time is extended, owing to the fact that a specific part of the impurities will be present in the oxidic slag phase, and this has been found to retard the rate of volatilization from the sulphide phase, most probably for thermodynamic reasons. Thus, it is also important for the method that the slag formed during the smelting step is carefully separated therefrom prior to beginning the rolling treatment process.

Smelting of the copper raw material can take place in conventional furnaces of the types previously described, for example in electrical furnaces or flash smelting furnaces, but in many cases it may be an advantage to smelt the copper raw material batchwise, directly in a Kaldo converter, for example when copper raw material is processed compaign-wise, the freedom of choice of the compositions of copper raw material being greatly increased thereby. For example, copper concentrates having antimony contents of up to 10% and more can be treated with the method according to the invention when smelting takes place in a Kaldo converter, Consequently, it is preferred in accordance with the invention to carry out the rolling treatment process in a rotary converter of the Kaldo type suitable for the smelting of copper raw material. The conversion process following the rolling treatment process can also be carried out in a similar manner. For example, blowing to copper sulphide (white metal) can be carried out in a separate unit, such as a Kaldo converter, while final blowing to blister copper can be carried out in a conventional PS-converter. In many instances, however, it may be an advantage to carry out the rolling treatment process in a rotary converter of the Kaldo type used for converting copper matte to blister copper. It may also be an advantage to carry out both the smelting process, rolling treatment process and converting process in a rotary furnace of the Kaldo type. In this case, the same furnace units, or different furnace units, may be used for the different steps.

The amount of gas required for the rolling treatment process is approximately 350–400 $Nm^3$ per ton of copper matte containing approximately 5% antimony or more, in order to obtain an antimony-elimination degree of approximately 50%. During this antimony eliminating step, approximately 75% of the bismuth content and approximately 60% of the zinc and approximately 85% of the arsenic present is also volatilized. In order to obtain an antimony elimination of approximately 75% there is required approximately 600–650 $Nm^3$ of gas per ton of copper matte. When the antimony is eliminated to this extent, bismuth is volatilized to almost 100%, whilst zinc and arsenic are volatilized to approximately 65 and 90% respectively.

In the following, the invention will be described with particular reference to the most advantageous embodiments thereof, which embodiments are suitable from many aspects for working complex copper smelt material. The mechanical agitation of the smelt ensures that a good mixing and a good contact between different phases and reactants are obtained. The temperature as well as the oxygen potential for the gas phase can be controlled by using additive fuel. The process is a batch process and can be divided into the following steps:

1. Autogenous smelting to copper matte.
2. Elimination of impurities by rotating the converter and maintaining a controlled atmosphere.
3. Converting the matte to white metal.
4. Converting the white metal to blister copper.

When the process is carried out in a Kaldo converter, the smelting and converting of the material can take place autogenously, since 100% oxygen can be blown into the converter if so required. During the smelting stage, dried concentrates, slag formers and returned dust are pneumatically charged to the furnace through tuyeres. A data processing apparatus is used to calculate the charging rate, the oxygen-concentrate ratio and the quantity of air required, for the purpose of maintaining a heat balance and the desired matte quality. The autogenous smelting of the concentrates continues until the converter is filled to the desired level. The slag is then tapped-off and transferred, for example, to a slag-treatment plant, such as a so-called slag fuming furnace. In the case of complex copper raw materials, high contents of impurities such as Bi, As, Sb, Zn and Pb are often present. The contents of these impurities in the matte is therefore lowered in a step in which the converter is rolled, for example, at a speed of approximately 30 r.p.m. and at an angle to the horizontal plane of approximately 15°–25°. At the same time, oil and oxygen air are blown into the converter. By controlling the amount of fuel and oxygen-air charged to the furnace it is possible to maintain the temperature at the level desired and to control the oxygen potential of the gas phase in a manner such that the impurities are volatilized to a substantial extent. The conversion to white metal and blister copper is then carried out in a normal manner. Slag formers necessary for the conversion of the matte to white metal are charged continuously. The slag obtained during these conversion stages is returned to the next smelting cycle.

EXAMPLE

A smelting campaign comprising the treatment of a multiplicity of charges of complex copper concentrates was carried out in a Kaldo converter having a capacity of 5 tons. In each charge 7 tons of concentrates were charged to the converter continuously and melted therein at 1200°–1300° C., whereafter the slag was drawn off. The smelting rate in order to obtain a copper matte having approximately 40% copper from concentrates containing approximately 22% copper, 30% Fe and 34% S was approximately 5 tons/h. The oxygen efficiency was 95%. The impurity contents of the concentrates treated during the smelting process varied within the limits given in Table I below.

TABLE I

| Impurity | % |
|---|---|
| Sb | 0,3–7 |
| As | 0,2–2 |
| Bi | 0,1–0,3 |
| Zn | 1–4 |
| Pb | 0,5–3 |

With respect to their high vapor pressure, As and Bi were mainly reduced to dust formed during the smelting process, while Sb was distributed uniformly between the liquid phases, i.e. slag and copper matte, as will be seen from the following Table II which illustrates in percent the mean values of distribution between the phases formed.

TABLE II

| Impurity | Copper matte | Slag | Dust |
|---|---|---|---|
| Sb | 36 | 28 | 36 |
| As | 9 | 7 | 84 |
| Bi | 17 | 3 | 80 |
| Zn | 30 | 50 | 20 |
| Pb | 34 | 12 | 54 |

Subsequent to removing the slag, the matte was treated in a neutral atmosphere by blowing oil, air and oxygen into the converter whilst rotating the same at 30 r.p.m. By controlling the amount of oil charged and the oil/oxygen ratio it was possible to regulate the oxygen potential and to maintain the temperature at the level desired. Some mean value relating to the elimination of impurities during the rolling treatment process are given in Table III below.

TABLE III

| Gas quantity | Impurity; Elimination in percent | | | |
|---|---|---|---|---|
| $Nm^3$/t matte | Sb | As | Bi | Zn |
| 200 | 18 | 40 | 42 | 12 |
| 600 | 48 | 75 | 77 | 33 |
| 1000 | 66 | 88 | 91 | 49 |
| 1400 | 80 | 92 | 95 | 63 |

Distribution in percent of impurities during following converting steps are shown in the following Table IV.

TABLE IV

| Impurity | Matte | Slag | Dust |
|---|---|---|---|
| | with 70% Cu | | |
| Sb | 12 | 63 | 25 |
| As | 15 | 17 | 68 |
| Bi | 30 | 5 | 65 |
| Zn | 5 | 60 | 35 |
| Pb | 31 | 35 | 34 |

The volatilization of impurities such as As, Sb and Bi was low during the terminal white-metal blowing process, because these impurities are mainly distributed in the copper phase and have a low activity there. In the case of antimony, for example, the distribution factor (% Sb in the copper phase/% Sb in the white metal phase) is approximately 13.

It has been found in tests that concentrates having antimony contents of up to approximately 10% and higher can be treated with good results in accordance to the invention, provided that the rolling—treatment process is extended to the necessary extent.

It will be understood from the aforegoing that there is provided through the present invention an advantageous method in which it is possible in a simple manner to lower the content of, primarily, antimony and also other troublesome impurities in copper matte. The impurities present in the copper matte are eliminated preferably to an extent such, in dependence upon the copper content of the matte and the subsequent converting method, that acceptable low contents of said impurities are now obtained in the blister copper. The method according to the invention enables the economic use of materials having relatively very high antimony contents, for example over 10%, wherewith hitherto, substantially unusable, inexpensive materials become attractive as copper raw materials.

We claim:

1. A method of producing blister copper from antimony-containing copper raw material including smelting of the copper raw material during formation of matte and a slag and converting said matte to blister copper, characterized in that the slag is separated from the copper matte, whereupon the copper matte prior to being converted to blister copper, is brought into contact, under violent agitation, with a gas, neutral to the matte in a quantity sufficient to reduce by volatilization the antimony content of the copper matte and also the content of any other impurities selected from the group consisting of bismuth, arsenic and zinc to a level acceptable when performing the subsequent converting process to obtain the desired blister copper product.

2. A method according to claim 1, characterized in that said agitation of the copper matte is carried out by rolling said matte in a rotary converter of the Kaldo type.

3. A method according to claim 2, characterized in that rolling of the copper matte is carried out with a furnace rotation corresponding to a peripheral speed at the cylindrical inner wall of the converter of approximately 0.5–7 m/s, preferably 2–5 m/s.

4. A method according to claim 1, characterized in that the gas comprises a combustion product of oil and oxygen or air enriched in oxygen.

5. A method according to claim 1, characterized in that the agitation process is carried out for a period of time of such magnitude until the final blister copper has reached a highest content of approximately 0.04% antimony and a highest content of approximately 0.03% bismuth.

6. A method according to claim 1, characterized in that the temperature during the agitation process is maintained within a range of approximately 1250°–1350° C.

7. A method according to claim 1, characterized in that the matte undergoing the agitation process has a copper content of approximately 25–60%.

8. A method according to claim 7, characterized in that said copper content is approximately 30–40%.

9. A method according to claim 1, characterized in that copper matte, slag former, such as sand, are added in conjunction with the agitation process.

10. A method according to claim 1, characterized in that said method is utilized to produce blister copper having a high silver content and a low antimony content from a silver-containing copper raw material.

11. A method according to claim 1, characterized in that the volatilization of antimony is carried out without substantial oxidation of the copper matte.

12. A method according to claim 2, characterized in that the rolling treatment process is carried out in a rotary converter of the Kaldo type used for the smelting of copper raw material.

13. A method according to claim 2, characterized in that the rolling treatment process is carried out in a rotary converter of the Kaldo type used for converting copper matte to blister copper.

14. A method according to claim 2, characterized in that both the smelting process and the rolling treatment process and converting process are effected in a rotary converter of the Kaldo type.

15. A method according to one of claims 12, 13 or 14, characterized in that the copper raw material and optionally a slag former are charged substantially continuously to the rotary converter and smelted autogenously therein by simultaneously adding air or oxygen-enriched air during the successive formation of copper matte and slag.

16. A method according to claim 15, characterized in that the successively formed smelt and copper matte and slag are maintained at a temperature of approximately 1200°–1300° C. during the smelting stage.

* * * * *